United States Patent [19]

Iizaka et al.

[11] 4,136,944

[45] Jan. 30, 1979

[54] LIQUID TYPE DEVELOPING APPARATUS

[75] Inventors: Isao Iizaka, Shinshiro; Osamu Miyamoto, Toyokawa, both of Japan

[73] Assignee: Minolta Camera Kabushiki Kaisha, Japan

[21] Appl. No.: 842,799

[22] Filed: Oct. 17, 1977

[30] Foreign Application Priority Data

Oct. 18, 1976 [JP] Japan ..... 51-125105
Oct. 26, 1976 [JP] Japan ..... 51-144372
Nov. 6, 1976 [JP] Japan ..... 51-149090

[51] Int. Cl.[2] ..... G03G 15/10
[52] U.S. Cl. ..... 355/10; 118/662
[58] Field of Search ..... 96/1 LY; 118/638, 651, 118/661, 662; 355/10; 427/15

[56] References Cited

U.S. PATENT DOCUMENTS 3,774,574 11/1973 Sato et al. ..... 355/10 X
3,783,827 1/1974 Fukushima et al. ..... 355/10 X
3,990,793 11/1976 Anzai et al. ..... 355/10
4,077,712 3/1978 Imaizumi et al. ..... 355/10
4,079,697 3/1978 Nagai et al. ..... 118/662

*Primary Examiner*—A. D. Pellinen
*Attorney, Agent, or Firm*—Watson, Cole, Grindle & Watson

[57] ABSTRACT

A liquid type developing apparatus includes a developing liquid chamber containing a developing liquid comprised of toner and an organic solution. A recording sheet having an electrostatic latent image on its surface passes between a pair of upper and lower electrically conductive electrode members arranged so that at least one of such members contacts the developing liquid. An electric power source is connected to one of the electrode members for impressing a bias voltage thereto, such one member being arranged in non-contacting relationship with the chamber, and the other of such members being arranged in electrically conductive relationship with the tank, whereby any leakage of the impressed voltage due to attraction of the toner to the members, the tank or to bearings provided for the members, is substantially avoided.

6 Claims, 6 Drawing Figures

LIQUID TYPE DEVELOPING APPARATUS

BACKGROUND OF THE INVENTION

1. Field of the Invention

This invention relates generally to a liquid type developing apparatus, and more particularly to such an apparatus in which a bias voltage is impressed on electrically conductive electrode members thereof.

2. Description of The Prior Art

It is known in the prior art liquid type developing machines to impress a bias voltage on pairs of roller electrodes and the like, which are of electrically conductive material and are positioned in a developing liquid tank, so as to thereby prevent fogging and stains on the back surface of a recording sheet passing between the rollers, or to permit a reverse development wherein the toner is attracted to a portion of a surface of the sheet which is devoid of an electrostatic latent charge, while preventing the toner from attracting to such a portion of the sheet which has such charge. With such an arrangement, when a bias voltage is impressed on the rollers, one of plural pairs of such rollers must be electrically insulated from a grounded element of the apparatus as, for example, the developing liquid tank, so that such one roller is mounted in place by means of insulating bearings for electrically insulating such roller from the grounded element of the apparatus so that the bias voltage effectively acts between pairs of the rollers after commencement of the image forming operation.

However, when such a developing apparatus is operated for an extended period of time, the electrically conductive toner dispersed in the insulating organic solution of the developing liquid tends to attract to the rollers, to the liquid developing tank as well as to the insulating bearings, the rollers being impressed with a voltage of a polarity opposite the charging polarity of the toner. If the toner is attracted to the insulating bearings, an electrically conducting condition will occur between the rollers and the liquid developing tank via the toner thus attracted, with the result that the bias voltage impressed between the roller pairs tends to leak, thus losing its intended function. This results in a fogging and a staining on the back surface of the copy sheet due to development. And, the short-development is incurred upon reversal development so that the consistent developing characteristic cannot be maintained for a long period of time.

The shortcoming as characterized above is particularly notable in an apparatus using a liquid developer including a high toner density such as, for example, a toner useable in an electrostatic latent image transfer type electrophotographic producing apparatus. More particularly, shortly following commencement of the operation of such apparatus, the function of the impressed bias voltage is lost. This results in the need to clean the developing apparatus by removing the toner thus attracted, thereby presenting many maintenance problems.

Moreover, when the toner is attracted to the rollers, on which a voltage of a polarity opposite the charging polarity of the toner is impressed, the rollers become stained thereby requiring provision of some means for cleaning the rollers. An approach used for cleaning includes a cleaning member made of felt or the like which is brought into press-contact with the rollers so that the toner attracted to the surface thereof is wiped off during roller rotation. The cleaning member is normally positioned so as to press-contact the roller by means of a holder, or is provided on a shaft which is rotatably mounted so as to be driven and rotated together with the roller or by some suitable drive means for the purpose of wiping toner off the surface of the roller. Typically, such a holder and its shaft are of metal so as to enhance their workability and durability. In addition, the holder and shaft are secured to a liquid developing tank which is grounded so that the holder and shaft remain at a ground potential. However, since the cleaning member is typically made of an insulating material, the roller is prevented from being conductive through the liquid developing tank which is maintained at a ground potential via the holder and shaft.

When an apparatus in accordance with such an arrangement is operated for an extended period of time, the amount of toner clinging to the cleaning member increases thereby increasing the electrical conductivity of the cleaning member itself due to the electric conductivity of the toner particles. As a result, a roller on which a bias voltage is impressed is rendered conductive with the liquid developing tank which remains at a ground potential, the holder or shaft, thus causing a leak of the bias voltage. As a result, the intended function of the bias voltage is lost bringing about an accompanying unstable developing characteristic.

Such a phenomenon is particularly noticeable during roller cleaning wherein the roller is impressed with a bias voltage of a polarity opposite the charging polarity of the toner particles.

SUMMARY OF THE INVENTION

It is therefore an object of the present invention to provide a liquid type developing apparatus in which a bias voltage may be effectively impressed in a stable condition for an extended period of time.

Another object of the present invention is to provide a liquid type developing apparatus which avoids leakage of the bias voltage due to attraction of the toner.

A further object of the present invention is to provide a liquid type developing apparatus which maintains a member, on which a bias voltage is impressed, in non-contacting relationship with a liquid developing chamber which is grounded.

A liquid type developing apparatus provided according to the invention includes an electrically conductive electrode member contacting a developing liquid, an opposed electrically conductive electrode member defining a passage with the first-mentioned member through which a copy sheet having an electrostatic latent image on its surface passes, an electric power source connected to the electrode members, and a developing liquid chamber containing developing liquid and including the first-mentioned electrode member in non-contacting relationship therein, whereby an insulating condition of an electrode member from the developing liquid chamber may be maintained for an extended period of time thereby preventing leakage of the bias voltage and maintaining a consistent developing characteristic throughout operation of the apparatus. And, because toner attraction is avoided with the present apparatus, it is rendered easy to maintain.

Other objects, advantages and novel features of the invention will become more apparent from the following detailed description of the invention when taken in conjunction with the accompanying drawings.

DETAILED DESCRIPTION OF THE INVENTION

Figure 1:
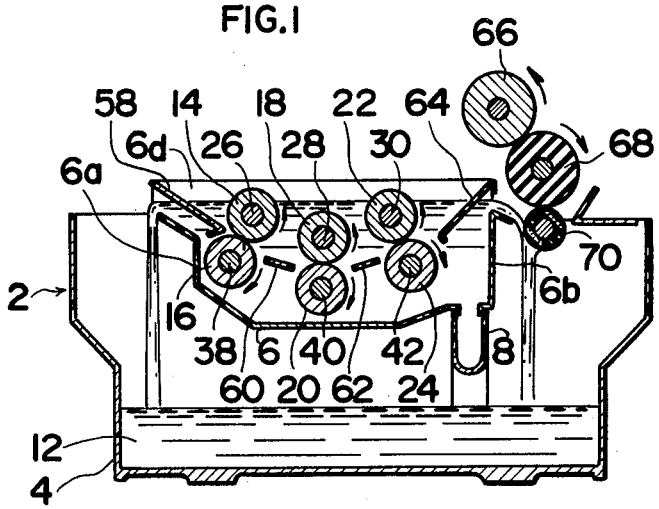
FIG. 1 is an end elevational view shown in section through the liquid type developing apparatus for use in an electrophotographic reproducing apparatus according to the invention.
Figure 2:
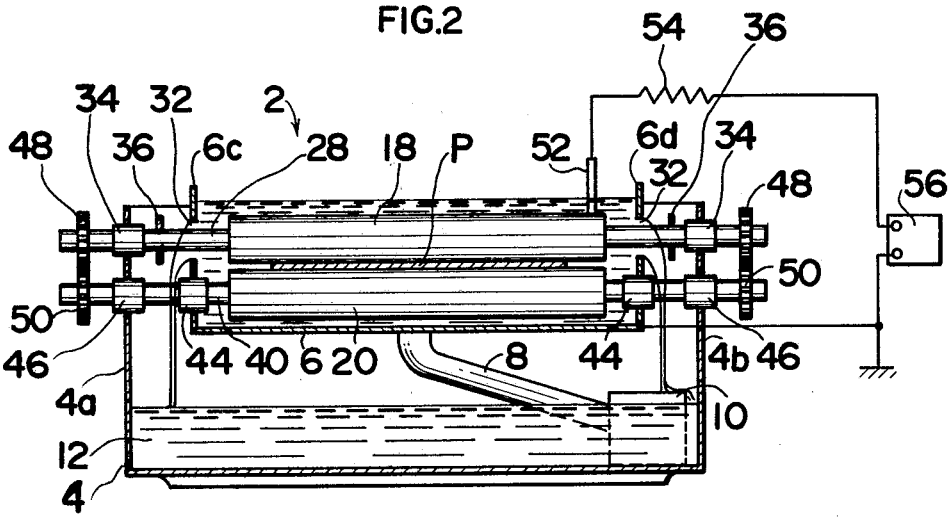
FIG. 2 is a side elevational view in section of the FIG. 1 apparatus.

A liquid type developing apparatus is generally designated 2 in FIGS. 1 and 2 and includes a developing liquid tank 4 having a developing liquid chamber 6 supported within the tank. At least chamber 6 is made of an electrically conductive material. Side plates 6*a* and 6*b* of chamber 6 are disposed closer to the bottom of the tank than end plates 6*c* and 6*d* of the chamber, and one end of a developing liquid supply pipe 8 opens into the bottom wall of chamber 6. The opposite end of pipe 8 is operatively connected to pump 10 disposed on the bottom wall of tank 4. A developing liquid 12 is contained within the tank and comprises an electrically conductive toner and an insulating organic solution. The liquid developer is supplied from the tank through pipe 8 and into chamber 6, and then overflows side plates 6*a* and 6*b* so as to fall back into the tank along a circulating path.

Three pairs of developing electrode rollers 14,16, 18,20 and 22,24, each of electrically conductive material, are provided within chamber 6. Three openings 32 are provided in each end wall 6*c* and 6*d*, (only one of such openings being shown in FIG. 2 in each end wall), each such opening having a diameter greater than the diameters of their associated shafts 26, 28 and 30 on which rollers 14, 18 and 22 are supported. Each shaft 26, 28 and 30 extend through openings 32 in the end plates in a non-contacting relationship therewith, and are rotatably supported on end plates 4*a* and 4*b* of the tank by means of insulating bearings 34 as the shafts extend outwardly of end plates 4*a* and 4*b*. Insulating elements 36 are provided on each of the shafts 26, 28 and 30 between plates 6*c* and 6*d* and the respectively adjacent end plates 4*a* and 4*b* of the tank. Elements 36 serve to prevent developing liquid, which flows out of openings 32 of the developing liquid chamber, from moving along shafts 26, 28 and 30 toward insulating bearings 34. These, elements 36 may be of a ring-shaped insulating material such as an acrylic resin.

Shafts 38, 40 and 42 are provided for lower rollers 16, 20 and 24 and extend through chamber 6 and outwardly of tank 4. These shafts are journaled in electrically conductive bearings 44 and 46 secured to end plates 6*c* and 6*d* of the chamber and to end plates 4*a* and 4*b* of the tank. Gears 48 and 50 are respectively mounted on the upper and lower shafts in toothed engagement with one another and are operatively connected with a drive gear (not shown) for rotating the developing electrode rollers in the directions of the arrows shown in FIG. 1.

Contact elements 52 are provided in contacting relationship with upper rollers 14, 18 and 22 as in any normal manner. These elements are respectively connected via protective resistances 54 with a bias electric power source 56. The resistance of protective resistances 54 range from $10^5$ to $10^7$ ohms, while a voltage at bias electric power source 56 ranges from 5 to 25 volts. On the other hand, lower rollers 16, 20 and 24 are electrically connected via electrically conductive bearings 44 to the developing liquid chamber 6, which in turn is connected to apparatus 2 which is grounded. The upper electrode rollers 14, 18 and 22 have the same polarity as that of an electrostatic latent image formed on copy sheet P, i.e., a negative charge. Lower electrode rollers 16, 20 and 24 are positively charged via developing apparatus 2 which is grounded.

Guide plates 58, 60, 62 and 64 are provided in chamber 6 for copy sheet P, such plates being made of an electrically conductive material. A pair of discharge and squeeze rollers 66 and 68 are rotatably mounted on the apparatus near the exit path of the copy sheet and are maintained in pressing engagement with one another. And, a sponge roller 70 is mounted on the apparatus for rotation by roller 68, such roller being provided to receive developing liquid 12 as it overflows end plate 6*b*.

The operation of developing apparatus 2 is as follows. When an electric power source switch (not shown) for the reproducting apparatus is turned on, a drive means (also not shown) is actuated for rotating electrode roller pairs 14,16, 18,20 and 22,24 as well as squeeze rollers 66 and 68 in the directions of the various curved arrows shown in FIG. 1. Simultaneously therewith, pump 10 is actuated for supplying developing liquid 12 from tank 4 into chamber 6, whereafter the liquid overflows end plates 6*a* and 6*b* and returns back into the tank through openings 32. Developing liquid flowing out of openings 32 flows along shafts 26, 28 and 30. However, travel of the developing liquid along these shafts is interrupted by insulating members 36 causing the developing liquid to fall back into the tank thus isolating the liquid from insulating bearings 34. As a result, the toner in the developing liquid does not attract to insulating bearings 34 thus precluding electric conductance between upper rollers 14, 18, 22 and tank 4. Moreover, shafts 26, 28 and 30 extending through openings 32 remain at all times out of contact with end plates 6*c* and 6*d*, thereby precluding electric conductance between upper rollers 14, 18, 22 and chamber 6.

Copy sheet P, carrying an electrostatic latent image thereon, is moved along guide plates 58, 60, 62 and 64 by means of the electrode roller pairs. The copy sheet receives a supply of toner from the developing liquid which carries an opposite charge to the electrostatic latent image so as to render the latent image visible while moving along its path between the nips of the electrode roller pairs. At the same time, a negative charge of the same polarity as that of the electrostatic latent image on the copy sheet is impressed on upper rollers 14, 18 and 22 thereby supressing developments and hence the fogging on copy sheet P. After development, the copy sheet is discharged from the developing apparatus while being squeezed by rollers 66 and 68 so as to remove excess liquid therefrom and to deliver the developed copy sheet to a fixing station (not shown). The voltage at bias electric power source 56 is impressed on the electrode rollers when a copy sheet is moved between the nips of the roller pairs, or is otherwise impressed on protective resistance 54 when the copy sheet P is not being moved through the developing apparatus.

From the foregoing it can be seen that the upper electrode rollers, on which a bias voltage is impressed, are maintained out of contact with the developing liquid chamber and are journaled on the developing apparatus in such a manner that developing liquid is prevented from reaching their insulating bearings so that any leak of bias voltage due to attraction of toner is substantially prevented, thereby insuring a long and consistent developing characteristic.

It can be seen that shafts 26, 28 and 30 of upper rollers 14, 18 and 22 are in contact with developing liquid 12. Alternatively, these shafts may be so disposed so as to be out of contact with the developing liquid without departing from the scope of the present invention. Also, rather than impressing the bias voltage across upper and lower roller pairs as described, the bias voltage may be impressed across one of such roller pairs and an opposed electrode plate spaced from the upper rollers and provided in lieu of the lower rollers.

Figure 3:
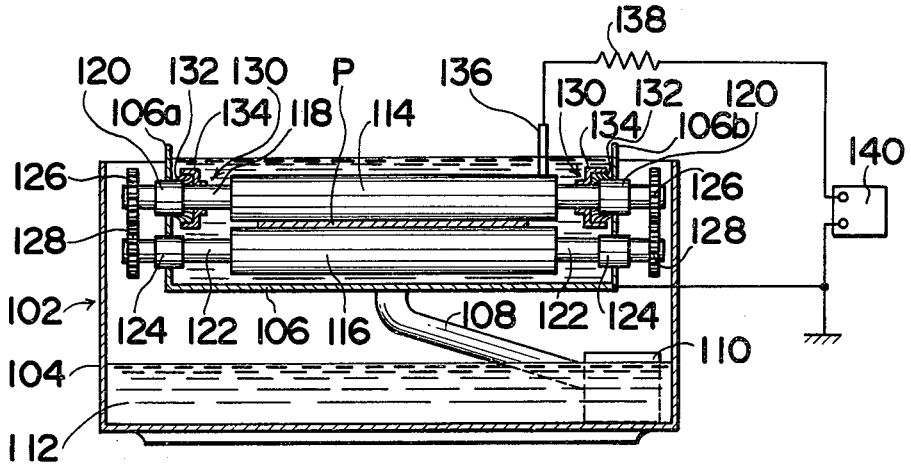
FIG. 3 is a view similar to FIG. 2 of another embodiment of the liquid type developing apparatus according to the invention.

Another developing apparatus, similar in construction to that shown in FIGS. 1 and 2, is generally designated 102 in FIG. 3, and includes a developing liquid tank 104 and a developing liquid chamber 106 mounted therein in spaced relation to the end, side and bottom walls of the tank. A liquid supply pipe 108 and a pump 110 are provided, similarly as in the FIGS. 1 and 2 embodiment, for circulating developing liquid 112. The liquid 112 supplied from the tank 104 through the pipe 108 overflows side plates of the chamber 106 (corresponding to the plates *6a, 6b* of FIG. 1) and circulates back into the tank 104. A suitable number of electrode roller pairs 114, 116 are provided in chamber 106. Shafts 118 of upper rollers 114 extend outwardly of end plates 106*a* and 106*b* of the chamber and are rotatably mounted by means of insulating bearings 120 mounted in suitable openings on these end plates. Similarly, shafts 122 of lower rollers 116 extend outwardly of end plates 106*a* and 106*b* and are rotatably mounted by means of electrically conductive bearings 124 mounted in suitable openings on these end plates. Intermeshed insulating gears 126 and 128 are mounted on the shafts of the upper and lower electrode rollers and are operatively connected to a drive means (not shown) for effecting rotation of the electrode rollers similarly as described with reference to FIG. 1. Cleaning members generally designated 130 are provided on shafts 118 of the upper rollers, and each comprise annular brushes 132 of insulating nylon plastic material or the like attached to an annular cover 134 mounted on the shaft. The brushes are near opposite ends of each shaft 118, surround the entire periphery thereof and are so mounted so as to contact end plates 106*a* and 106*b* as well as insulating bearings 120. Contact elements 136 are provided in contacting engagement with each of the upper rollers, and a protective resistance 138 and a bias electric power source 140 are interconnected similarly in the manner and for the purpose as described with reference to the FIGS. 1 and 2 embodiment.

Copy sheet P is developed by the FIG. 3 arrangement similalry as in FIG. 2 such that a voltage of a polarity opposite the charge of the toner in the developing liquid is impressed on upper rollers 114 so that the toner tends to be attracted to the upper rollers and their shafts 118 as well as to insulating bearings 120. However, the toner which is attracted to bearings 120 is removed therefrom by means of brushes 132 which rotate together with upper rollers 114. As a result, even if the developing apparatus 102 is operating for an extended period of time, electrically conductive toner is prevented from being attracted to insulating bearings 120 so that any leak of the bias voltage is substantially avoided and the desired developing characteristic may thereby be maintained for an extended period of time.

Figure 4:
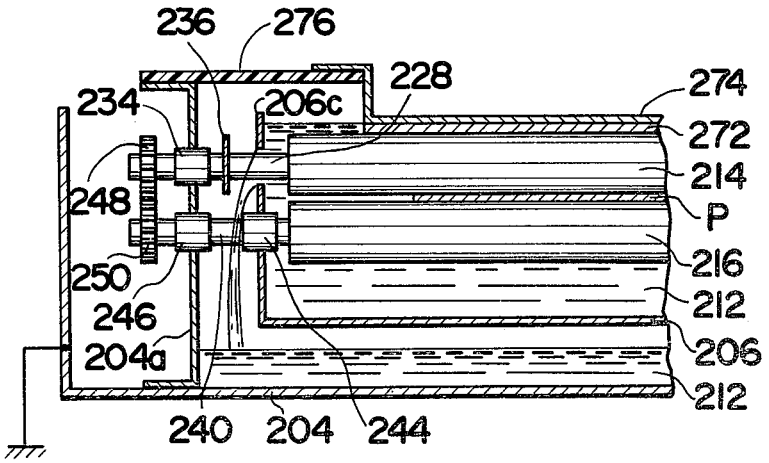
FIG. 4 is a partial sectional view similar to FIG. 2 of yet another embodiment of the liquid type developing apparatus according to the invention.

Another embodiment of the developing apparatus according to the invention is shown in FIG. 4 which is similar to that shown in FIG. 2 so that like elements are given like reference characters except that they are set forth in a 200 numerical series. Here, cleaning elements 272 of felt material or the like are provided in contacting relation with upper rollers 214 of electrode roller pairs 214 and 216, and are maintained in place by means of cover plates 274. Each cleaning element has a length sufficiently great to cover the maximum width of copy sheet P. Plates 274 to secured to an insulating plate 276 provided at opposite ends of the developing apparatus and mounted to the opposite end plates of tank 204 as typically shown in FIG. 4 wherein plate 276 is mounted to end plate 204*a*. Plates 276 are made of an oil-proof acrylic material, polyacetal resin, ABS, or the like, for electrically insulating plates 274 from the opposite end plates of the tank. Bias voltage of a polarity opposite the charging polarity of the toner in the developing liquid is impressed on upper rollers 214 so that any toner which tends to be attracted to the upper rollers may be wiped off by means of cleaning elements 272. During operation of the developing apparatus, electrically conductive toner is accumulated on the cleaning elements 272 in proportion thereto so that the cleaning elements themselves become electrically conductive. However, since the cleaning elements are secured to the opposite end plates of the tank by means of insulating plates 276, the voltage impressed on upper rollers 214 does not leak through the cleaning elements. And, it should be pointed out that plate 274 may be made of an insulating material extending toward the opposite end plates of the tank and secured thereto in lieu of insulating plates 276.

Figure 5:
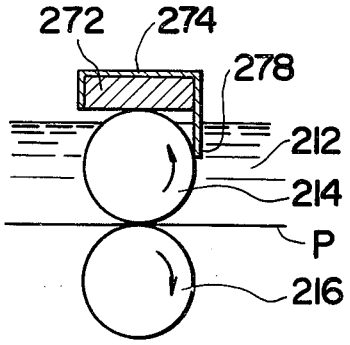
FIG. 5 is a detail view of the cleaning arrangement provided for the FIG. 4 arrangement.

A modification of holder 274 is illustrated in FIG. 5 wherein a portion of holder 274 extends toward lower roller 216, or a flange plate may be secured to holder 274 and extended in the same manner, thereby defining a blade member 278. Such a blade member is made of oil-proof resilient material such as polyurethane, rubber or the like, with the tip of the blade member being in contact with the surface of upper roller 214 so as to thereby scrape the toner thus attracted thereto. As a result, the amount of toner attracted to cleaning element 272 may be reduced so as to thereby enhance the durability of the cleaning element. Blade member 278 may be of electrically conductive or of insulating material, although it should preferably afford resiliency so as to enhance its contact with the upper rollers.

Figure 6:
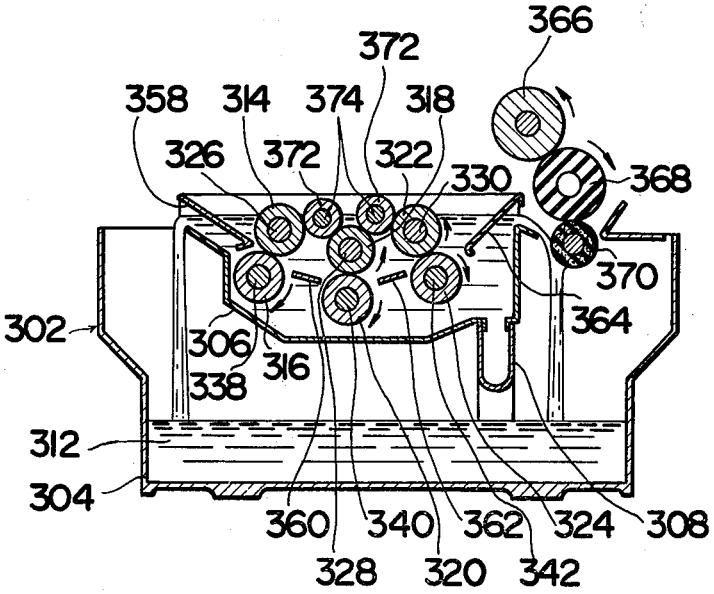
FIG. 6 is a sectional view of a liquid type developing apparatus according to the invention showing another type of cleaning member.

Another developing apparatus generally designated 302 is shown in FIG. 6 and is constructed similarly as apparatus 2 of FIG. 1 except that 300 series numerals are used to designate like parts between the two apparatuses. Here, a cleaning element 372 is wrapped about each shaft 374 made of an insulating material or material subjected to the insulating treatment for rotation together with each such shaft in a manner to contact electrode rollers 314, 318 and 322. When a bias voltage is impressed on upper electrode rollers 314, 318 and 322, similarly as described in the FIG. 1 embodiment, and any leak of such bias voltage may be avoided because the shaft 374 is positively insulated from the ground. Alternatively, shafts 374 of these elements may be rotated by some suitable means or may follow the rotation of electrode rolles 314, 318 and 322. In addition, if the cleaning elements are so disposed as to contact the developing liquid as shown in chamber 306 in FIG. 6, the toner which is attracted to the upper rollers and wiped off by cleaning elements 372 is returned to the developing liquid thus resulting in a decrease in the amount of toner to be used. Otherwise, if cleaning elements 372 are so disposed as to remain out of contact with the developing liquid with a portion of the upper rollers extending above the top surface of the liquid, any solidification of the toner wiped off the upper rollers by cleaning elements 372 is substantially avoided since the upper rollers remain wetted by the developing liquid during their rotation.

Obviously, many other modifications and variations of the invention are made possible in light of the above teachings.

It is, therefore, to be understood that within the scope of the appended claims the invention may be practiced otherwise than as specifically described.

We claim:

1. A liquid type developing apparatus including walls of electrically conductive material defining a chamber for containing a quantity of developing liquid of toner and organic solution, comprising:

first electrode means made of electrically conductive material and being mounted within said chamber in at least partial contact with the liquid contained therein;

second electrode means made of electrically conductive material and being mounted within said chamber in opposed relationship to said first electrode means for defining therewith a passage for a copy sheet, having an electrostatic latent image on a surface thereof, between said first and second electrode means;

electric power means for impressing a bias voltage on said first and second electrode means;

means mounting said first electrode means in non-contacting relationship with said chamber; and means connecting said second electrode means in electrically conductive relationship with said chamber;

whereby said first electrode means is electrically insulated from said chamber thereby preventing and leak of the bias voltage impressed between said first electrode means and said chamber.

2. The apparatus according to claim 1, wherein said first electrode means includes an electrode support member of a predetermined cross-section, opposing walls of said chamber having openings therein through which said member extends, said openings being of a size greater than said cross-section and edges of said openings being spaced from said support member for providing passages through which the developing liquid may flow outwardly of said chamber and for maintaining said non-contacting relationship between said first electrode means and said chamber.

3. The apparatus according to claim 2, wherein said first electrode mounting means is located outwardly of said chamber, and means being provided on said support member between said openings and said mounting means for preventing the developing liquid from reaching said mounting means which are disposed at opposed ends of said support member.

4. The apparatus according to claim 3, wherein said preventing means comprise discs of electrically insulating material.

5. The apparatus according to claim 1, wherein said mounting means includes a liquid developing tank having opposing walls and insulating bearings mounted thereon, said support member being supported by said bearings.

6. A liquid type developing apparatus including walls of electrically conductive material defining a chamber for containing a quantity of developing liquid of toner and an organic solution, comprising:

a plurality of first electrode rollers made of an electrically conductive material and having first shafts rotatably supporting said rollers within said chamber;

a plurality of second electrode rollers made of an electrically conductive material and having second shafts rotatably supporting said second rollers within said chamber;

said first and second rollers forming a passage therebetween for the passage therethrough of a copy sheet having an electrostatic image on a surface thereof;

electric power means for impressing a bias voltage on said first rollers of a polarity opposite that of said toner;

said first shafts having a predetermined cross-section, and opposing walls of said chamber having openings therein through which said first shafts extend, said openings being of a size greater than said cross-section and edges of said openings being spaced from said first shafts for providing passages through which the liquid may flow outwardly of said chamber and for maintaining a non-contacting relationship between said first shafts and said chamber;

means disposed outwardly of said chamber mounting said first shafts including electrically insulating bearings on opposite ends of said first shafts; and means on said first shafts between said openings and said bearings for preventing the developing liquid from reaching said bearings when flowing out of said openings;

whereby leak of said bias voltage between said first electrode rollers and said chamber is substantially prevented.

* * * * *